US005637183A

United States Patent [19]

Börner

[11] Patent Number: 5,637,183

[45] Date of Patent: Jun. 10, 1997

[54] PROCESS AND ARRANGEMENT FOR CONVEYING FLAT WORKPIECES

[75] Inventor: Wilhelm Börner, München, Germany

[73] Assignee: Herbert Meyer GmbH & Co. KG, Munich, Germany

[21] Appl. No.: 416,918

[22] PCT Filed: Jun. 29, 1994

[86] PCT No.: PCT/EP94/02110

§ 371 Date: Apr. 21, 1995

§ 102(e) Date: Apr. 21, 1995

[87] PCT Pub. No.: WO95/05759

PCT Pub. Date: Mar. 2, 1995

[30] Foreign Application Priority Data

Aug. 24, 1993 [DE] Germany ..... 43 28 461.2

[51] Int. Cl.[6] ..... B32B 31/04

[52] U.S. Cl. ..... 156/547; 156/548; 156/553; 156/556; 198/812

[58] Field of Search ..... 156/547, 548, 156/553, 556; 198/812, 558

[56] References Cited

U.S. PATENT DOCUMENTS

| | | | |
|---|---|---|---|
| 3,508,672 | 4/1970 | Stanoy et al. | 198/312 |
| 3,556,280 | 1/1971 | Schnee | 198/31 |
| 3,751,873 | 8/1973 | Toby | 53/59 R |
| 4,141,443 | 2/1979 | Halsey | 198/471 |
| 4,357,197 | 11/1982 | Wilson | 156/354 |
| 4,469,219 | 9/1984 | Cosse | 198/460 |
| 4,570,414 | 2/1986 | Focke et al. | 53/373 |
| 5,046,603 | 9/1991 | Odenthal | 198/812 |

FOREIGN PATENT DOCUMENTS

| | | |
|---|---|---|
| 24 699 B | 5/1984 | Austria . |
| 11 89 919 | 11/1960 | Germany . |
| 11 32 861 | 7/1962 | Germany . |
| 19 20 387 | 4/1965 | Germany . |
| 1 456 850 | 3/1969 | Germany . |
| 1 296 579 | 5/1969 | Germany . |
| 73 17 511 | 9/1973 | Germany . |
| 1 556 704 | 2/1978 | Germany . |
| 27 24 980 B1 | 11/1978 | Germany . |
| 33 38 068 A1 | 6/1984 | Germany . |
| 34 03 986 A1 | 10/1984 | Germany . |
| 37 34 660 A1 | 4/1989 | Germany . |
| 38 41 727 A1 | 11/1989 | Germany . |
| 39 15 091 A1 | 12/1989 | Germany . |
| 39 03 820 C2 | 8/1990 | Germany . |
| 92 01 200 U1 | 5/1992 | Germany . |
| 41 24 810 A1 | 1/1993 | Germany . |
| 16 52 241 A1 | 5/1991 | U.S.S.R. . |
| 621 136 | 6/1946 | United Kingdom . |
| 2 029 353 | 3/1980 | United Kingdom . |

*Primary Examiner*—Nina Bhat

*Attorney, Agent, or Firm*—Lahive & Cockfield, LLP

[57] ABSTRACT

A process and apparatus for processing flat workpieces, in particular for carrying out operations between fabric pieces in superposed relationship, feeding the workpieces to a continuously operating workstation by pre-conveyors that cooperate with subsequent conveyors. The pre-conveyor and each subsequent conveyor are so arranged that, upon starting the pre-conveyor with a workpiece on its conveyor path, the conveyor path of the pre-conveyor is extended over the conveyor path of the subsequent conveyor to such an extent that the workpiece can be moved over the conveyor path of the subsequent conveyor. When that position is adopted, the conveyor belt of the pre-conveyor is stopped and the workpiece is deposited on the conveyor belt of the subsequent conveyor by shortening the path of the pre-conveyor.

14 Claims, 7 Drawing Sheets

PROCESS AND ARRANGEMENT FOR CONVEYING FLAT WORKPIECES

The invention concerns a process for discontinuous pre-conveying of flat workpieces, in particular fabric pieces in superposed relationship which are to be glued together, to a subsequent conveyor, in a working cycle comprising three working steps, wherein in the course of a working cycle during the first working step when the pre-conveyor is in the stationary condition at least one workpiece is laid on the conveyor path thereof in the receiving region thereof, wherein in the second working step the pre-conveyor is set in operation and the workpiece laid thereon is moved to the subsequent conveyor, and wherein to complete said working cycle in the third working step the moved workpiece is transferred to the subsequent conveyor and the pre-conveyor is stopped again.

The invention also concerns arrangements for carrying out that process, in particular for feeding fabric pieces which are deposited one upon the other to a glueing apparatus.

Processes and arrangements for carrying such processes into effect, of the kind indicated, are known for example from DE 39 15 091 A1 and DE G 92 01 200.0. It is precisely in the situation involving feeding fabric pieces which are to be glued together, for example a cut piece of outer material and a cut piece of insertion material or interfacing material which is to be glued to the piece of outer material, that the fabric pieces which initially are only laid one above the other, hereinafter referred to as the workpiece, are transferred for glueing thereof to a continuously operating fixing press, on the entry side thereof. However, the workpieces, particularly when they are pieces of large area, can be satisfactorily laid on a conveyor belt only when the conveyor belt is stationary during the operation of laying the workpieces thereon. In other words, the workpieces which are to be glued together cannot be laid directly on the continuously advancing conveyor belt which passes the workpieces through the glueing apparatus. Therefore, for feeding the workpieces to the glueing apparatus, use is made of a pre-conveyor and an intermediate conveyor, which are arranged in succession in the direction of conveying movement, upstream of the glueing apparatus. Now, with this arrangement, when the pre-conveyor is in the stationary condition, the workpiece can be laid on the conveyor belt thereof and can then be transferred to the conveyor belt of the glueing apparatus, by way of the pre-conveyor and the intermediate conveyor. In order better to make use of the glueing apparatus, it is also possible for two intermediate conveyors to be disposed on the entry side thereof, in mutually parallel relationship. It is also possible to provide a pre-conveyor for more than one workpiece-feed working station.

This known structure for feeding workpieces to a glueing apparatus imposes arrangements which are of relatively great length in the direction of conveying movement of the workpieces and which thus afford little opportunity for adaptation to predetermined spatial factors. In addition this structure is also technically expensive because it must always make use of intermediate conveyors.

For a process of the kind described in the opening part of this specification and for arrangements for carrying such a process into effect, the object of the present invention is to provide a further configuration in which the mutual spatial arrangement of the pre-conveyor and the subsequent conveyor can be freely selected and in which moreover it is also possible to omit intermediate conveyors in the situation involving feeding workpieces to a glueing apparatus.

The invention is based on the essential realisation that extending the conveyor path of the pre-conveyor in the manner according to the invention not only permits any spatial association of the pre-conveyor and the subsequent conveyor, but it further affords the possibility that, while the workpiece which is moved on the conveyor belt of the pre-conveyor is being deposited on the conveyor belt of the subsequent conveyor, the pre-conveyor can already be in use again for laying a further workpiece thereon.

DE G 73 17 511 already discloses a stacking apparatus comprising a stacking table and a feeder arranged thereabove, in which both the feeder and also the stacking table are mounted movably in mutually parallel guides. With that arrangement, for the purposes of stacking fabric pieces on the stacking table, the stacking table and the feeder simultaneously perform a uniform but oppositely directed movement, the speed of which is equal to the speed of conveying movement of the feeder. In this case also, when moving a fabric piece in the direction of conveying movement, the feeder extends its conveyor path and reduces it in length again for the purposes of transferring the moved fabric piece on to the stacking table. However that known feeder is only suitable for a continuous conveying mode of operation and therefore does not permit a workpiece to be laid on its conveyor belt in the stopped condition thereof, with a simultaneous fresh reduction in its conveyor path length in opposite relationship to the direction of conveying movement.

The invention will now be described in greater detail hereinafter with reference to diagrammatic drawings and with reference to illustrated embodiments.

BRIEF DESCRIPTION OF THE DRAWING

In FIGS. 1 to 4, reference numeral 1 denotes a pre-conveyor and reference numeral 2 denotes a subsequent conveyor. The pre-conveyor 1 and the subsequent conveyor 2 are so arranged relative to each other that they are oriented with their directions of conveying movement perpendicularly to each other. In regard to the subsequent conveyor 2 the support stand structure is indicated by reference numeral 21 while the endless conveyor belt thereof is indicated by reference numeral 4. The pre-conveyor 1 has a table-like support stand structure 11 with two mutually parallel side walls 111 and an endless conveyor belt 3 which is guided around rollers. The roller 5 which is in the form of a drive roller, at the rearward end of the conveyor path, provides for deflecting the belt through 180° . Belt deflection also through 180° at the front end of the conveyor path is effected by way of a carriage or slider 6 which is displaceable in the direction of conveying movement, with a carriage head 60 having a ramp-like run-off profile configuration. In its travel region in opposite relationship to the direction of conveying movement of the pre-conveyor 1, the endless conveyor belt 3 is passed around belt direction-changing rollers 8 and 9 to constitute a belt loop storage device 7 which is variable in its size and which permits the carriage movement. For that purpose, a dancer roller 10 is provided between the belt direction-changing rollers 8 and 9 which are arranged at the same height at a predetermined spacing from each other. The dancer roller 10 forms the conveyor belt 3 downwardly beyond the belt direction-changing rollers 8 and 9 to provide a belt loop which is always tensioned.

Figure 1:
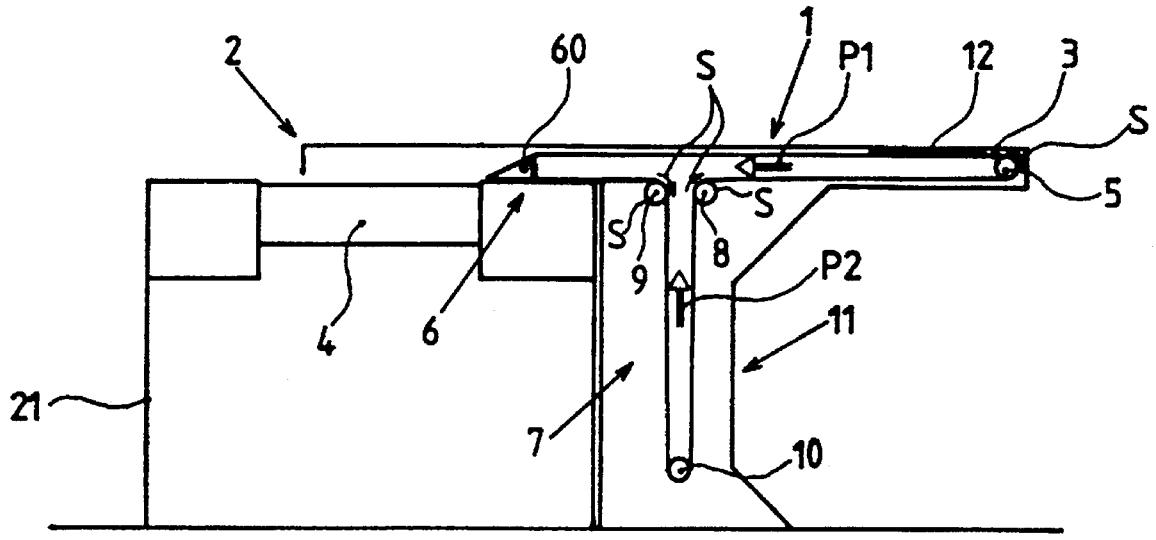
FIGS. 1 to 4 provide a description of the process by means of diagrammatic views of the pre-conveyor and the subsequent conveyor.

The laying working station (not identified in greater detail) is defined by the rear end of the conveyor path of the pre-conveyor 1. A workpiece 12 which for example comprises two fabric pieces deposited one upon the other can be laid on the conveyor belt 3 at the end of the roller 5, in the stationary condition of the conveyor belt. This involves the first working step of the pre-conveyor 1 which in each working cycle performs three working steps. This first working step is shown in FIG. 1. The sliding carriage 6 which with its carriage head 60 determines the front edge of the conveyor path is disposed at the right hand edge above the conveyor belt 4 of the subsequent conveyor 2 immediately prior to the start of the conveyor belt 3.

Figure 2:
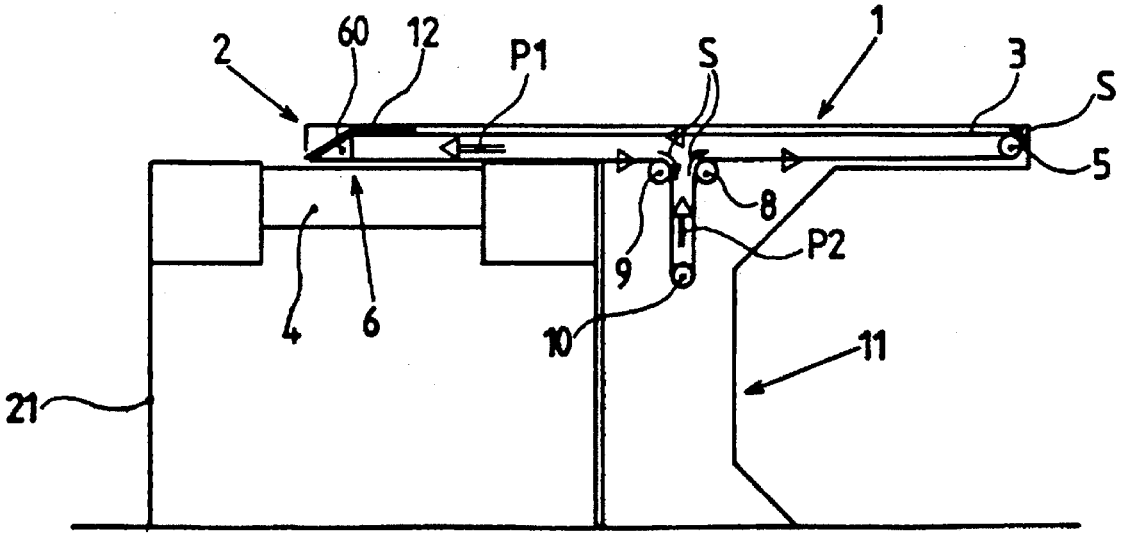

When the workpiece 12 has been laid on the conveyor belt 3, the operator (not shown in FIGS. 1 to 4) sets the pre-conveyor 1 in motion for carrying out the second working step in which the workpiece 12 laid on the pre-conveyor is moved to the subsequent conveyor 2. That working step is shown in FIG. 2. During the conveying operation, the conveyor path of the pre-conveyor 1 is extended in the direction indicated by the arrow P1 to a position over the middle of the conveyor path of the subsequent conveyor 2, by suitable movement of the carriage 6. The length of conveyor belt 3 which is required for that purpose is taken from the belt loop storage means 7, the dancer roller 10 of which moves upwardly in the direction indicated by the arrow P2 in that operation. In the displaced position shown in FIG. 2, the workpiece 12 has moved into a position in which it is disposed completely above the conveyor path 4 of the subsequent conveyor 2. Now, in the third working step which is shown in FIG. 30 the conveyor belt 3 of the pre-conveyor 1 is stopped and immediately thereafter the length of its conveyor path is reduced to its original length again by way of a return movement of the carriage 6 in the direction indicated by the arrow P3. The workpiece 12 is deposited on the conveyor belt 4 of the subsequent conveyor 2, by virtue of that return movement. The portion of belt which is liberated in that operation is again transferred into the belt loop storage device 7, which results in the dancer roller 10 moving downwardly in the direction indicated by the arrow P4.

Figure 4:
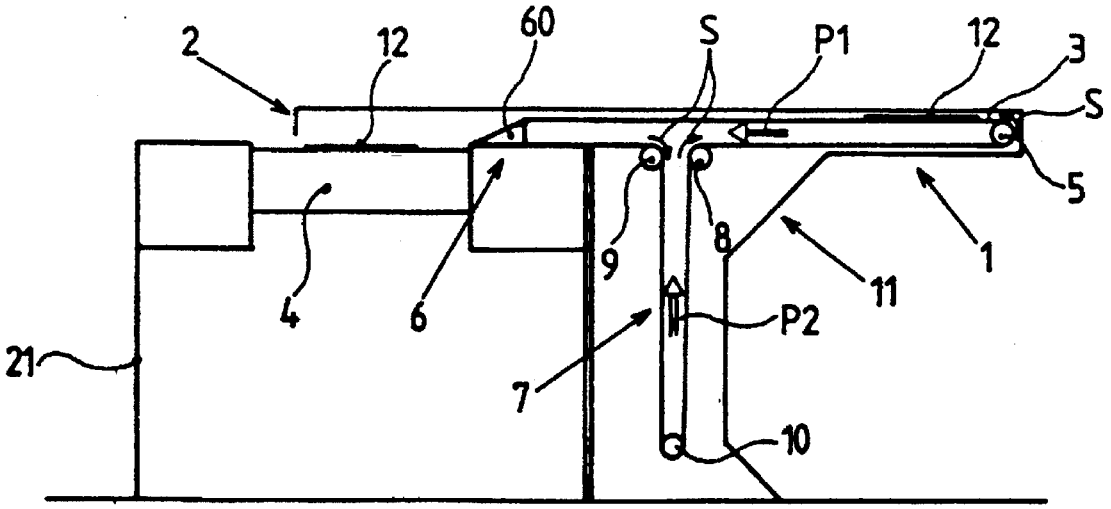

As soon as the carriage 6, in its return movement, has again reached its original right-hand starting position, the described working cycle is concluded. That condition is shown in FIG. 4.

Figure 5:
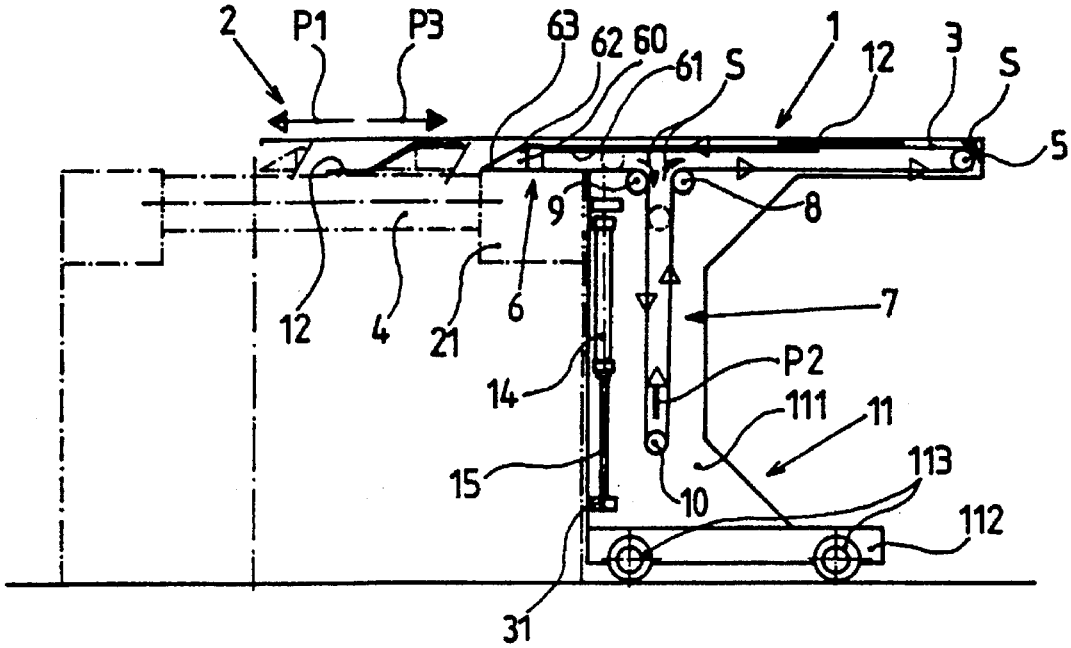
FIG. 5 shows a pre-conveyor, with more detailed features, including the subsequent conveyor, as shown in FIGS. 1 to 4.

In order to prevent the conveyor belt 3 running backwards in the return movement of the carriage 6, the roller 5 and the belt direction-changing rollers 8 and 9 are provided with reverse motion-blocking means which are indicated in FIGS. 1 to 4 but also in FIG. 5 by a respective arrow identified by S at each of the symbols representing the rollers.

Figure 3:
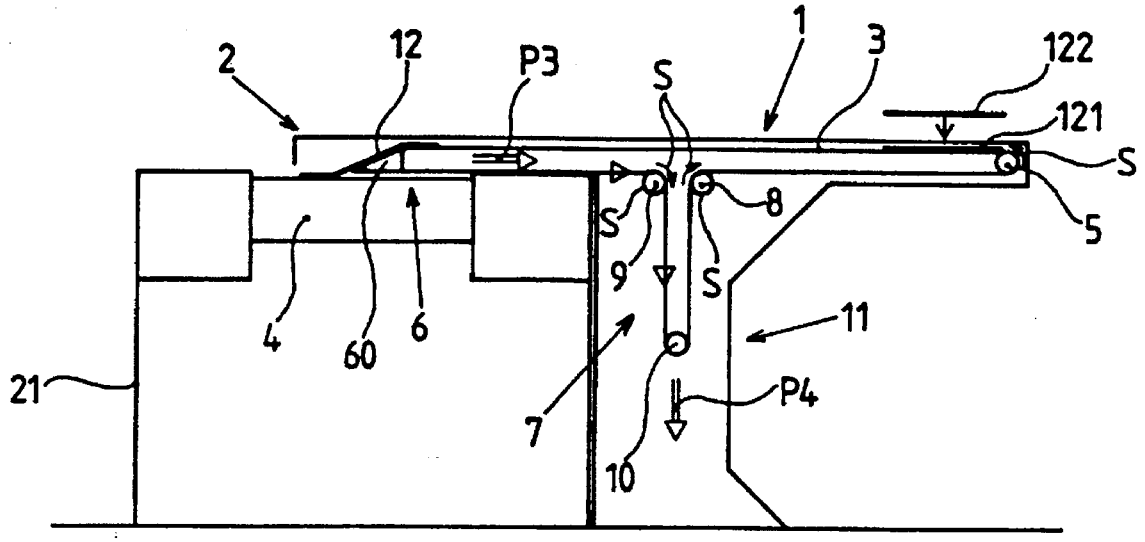

As the conveyor belt 3 is stationary in the region in which a workpiece is laid thereon, during the time that its conveyor path is reduced in length again, it is possible to begin again with the operation of laying a fresh workpiece 12 on the conveyor belt 3 while the third working step is already being carried out. The third working step which terminates a working cycle therefore overlaps in an extremely advantageous manner with the first working step of a fresh working cycle. In FIG. 3 this is indicated by a fabric piece 121 which has already been laid on the conveyor belt 3 again and which still has to be supplemented by the fabric piece 122 to be deposited thereon, to constitute the workpiece 12.

When the pre-conveyor 1 and the subsequent conveyor 2 are arranged with mutually perpendicular directions of conveying movement, it is generally appropriate for the conveyor belt 4 of the subsequent conveyor 2 to be stopped during transfer of a workpiece 12 from the pre-conveyor 1 to the subsequent conveyor 2. However, with a sufficiently high speed of return movement of the carriage 6, it is in principle also possible to provide a continuous mode of operation for the subsequent conveyor 2. In other words, the speed of return movement of the carriage 6 only has to be so high that the movement of the conveyor belt 4 of the subsequent conveyor 2 can no longer represent any disturbance or trouble in terms of the operation of transferring a workpiece 12.

FIG. 5 which again shows the pre-conveyor 1 with the subsequent conveyor 2, as illustrated in FIGS. 1 to 4, shows still further details of the pre-conveyor 1. The support stand structure 11 of the pre-conveyor 1 has at its base a wheeled chassis 112 which is provided with wheels 113 and by means of which the pre-conveyor 1 can be moved as required. The carriage 6 has a carriage plate 61, the front side of which is the carriage head 60 which has a ramp-like run-off profile configuration. The upper and the front lower belt edges of the carriage head 60 are embodied by tubes or bar rollers 61 and 62 which ensure easy sliding movement or rolling movement of the conveyor belt 3 over the carriage head 60. Fixed on the carriage plate 61 on both sides are guide sleeves 64, by way of which the carriage 6 is guided in guide reds 65. The guide rods 65 are mounted in guide rod holders 66 to the side walls 111 of the support stand structure 11.

Figure 7:
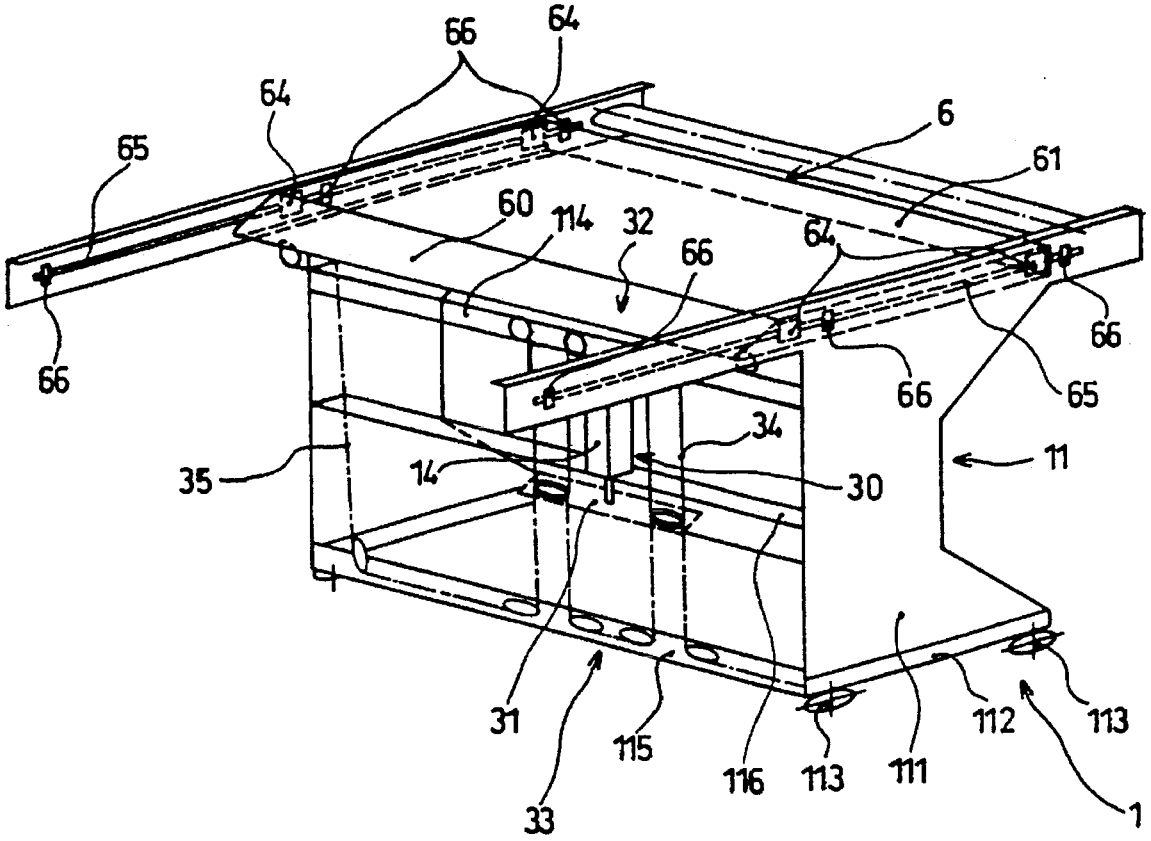
FIG. 7 shows a perspective view of the pre-conveyor shown in FIGS. 5 and 6 without conveyor belt.
Figure 8:
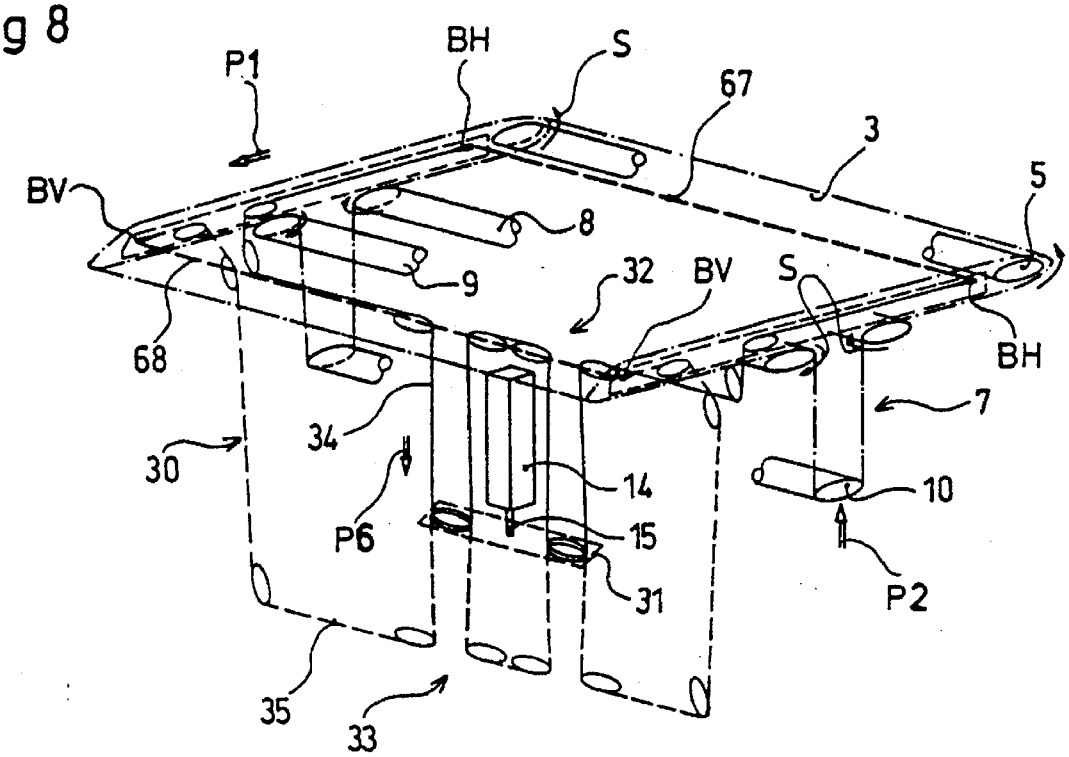
FIGS. 8 and 9 are diagrammatic views showing the cable drive of the carriage of the pre-conveyor shown in FIGS. 5 to 7.
Figure 9:
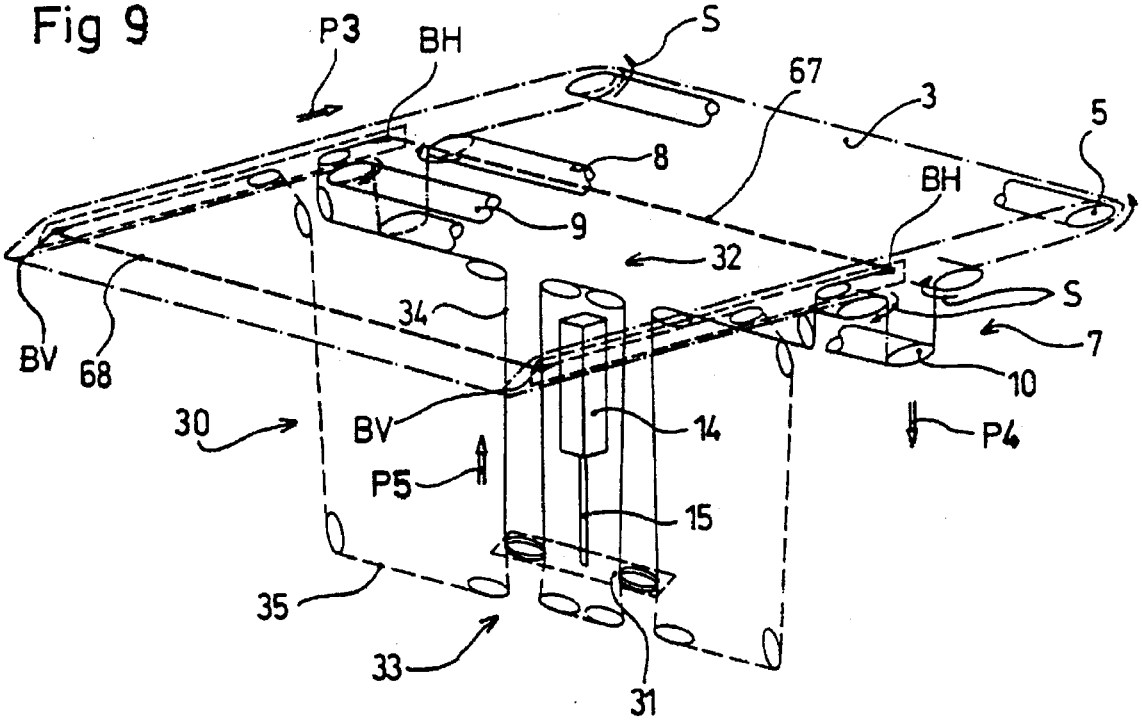

For displacement of the carriage 6 in the direction of conveying movement, it is connected to a cable drive 30 which is shown in FIGS. 7 to 9.

Figure 6:
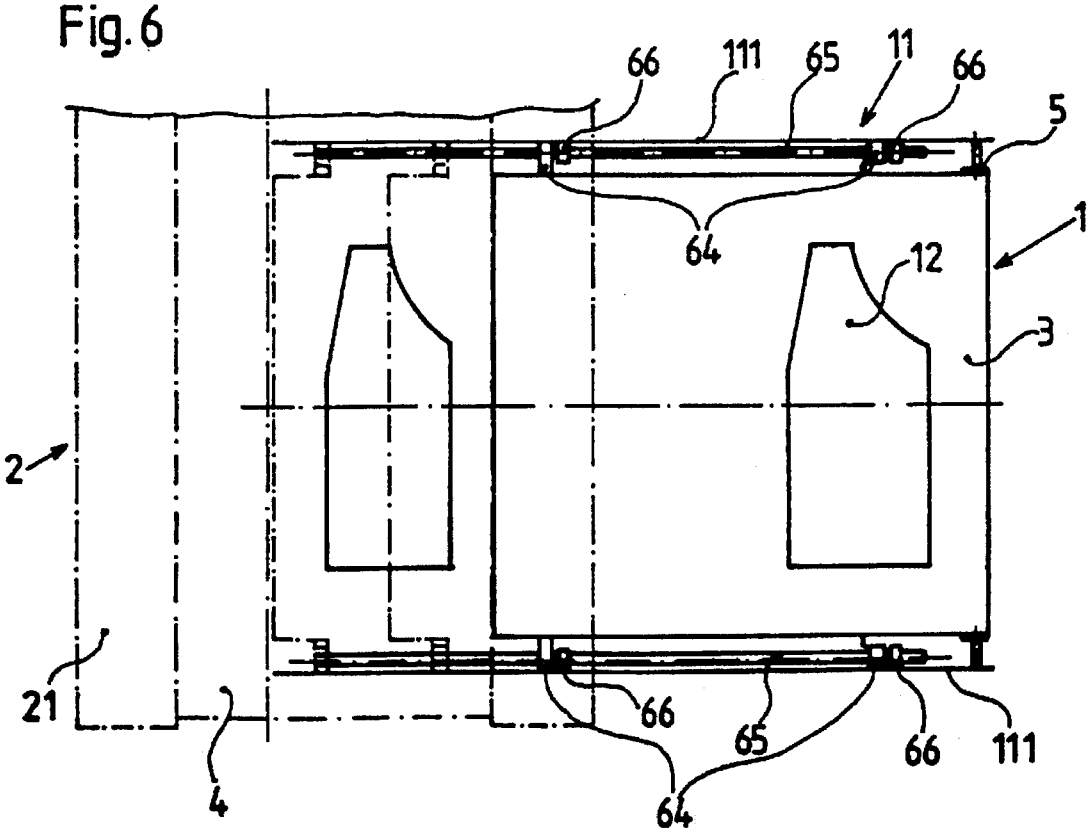
FIG. 6 is a plan view of the pre-conveyor and the subsequent conveyor shown in FIG. 5.

The perspective view of the pre-conveyor 1 as shown in FIGS. 5 and 6, in FIG. 7, permits a plan view of the carriage 6 with its cable drive 30. The cable drive 30 has a stroke cylinder 14 which is fixed to the central transverse strut 116 of the support stand structure 11 and whose stroke rod 15 carries a roller head 31 at its free end. By way of its rollers which are not identified in greater detail in FIG. 7, the roller head 31 is engaged with the tension cables 34 and 35 shown in broken line. The cables 34 and 35 which are respectively fixed to the carriage plate 61 further run in rollers (not identified) of roller guides 32 and 33 on the support stand structure. In that arrangement, to provide a pulley block function, the cable 34 forms an upper double loop by way of the four central rollers of the roller guide 34 on the upper transverse strut 114 and the rollers, which are associated therewith, of the roller head 31. In the same manner, to provide a pulley block function, the cable 35 forms a lower double loop by way of the four central rollers of the roller guide 33 on the lower transverse strut 115 and the rollers, which are associated therewith, of the roller head 31.

Further details of the cable drive 30 are shown in the diagrammatic views in FIGS. 8 and 9, with reference to which the mode of operation of the cable drive (30) is also to be described in greater detail. The carriage itself is not shown in these Figures for the sake of clarity of the drawing. It is however indicated by the two connecting lines 67 and 68 illustrated in broken line with heavier marking. The end points of the connecting line 67 in that arrangement represent the fixing points BH of the cable 34 in the rear region of the carriage plate 61 and the end points of the connecting line 68 represent the fixing points BV on the carriage plate 6 in the front region thereof. To provide for better distinction, the cable 34 is shown by a solid line and the cable 35 is shown by an interrupted line, in FIGS. 8 and 9.

In FIG. 8 the cylinder 14 moves its stroke rod 15 with the roller head 31 downwardly in the direction indicated by the arrow P6. Here the tension cable 34 is put under a tensile loading and causes the carriage 6 to move forwardly as indicated by the arrow P1, in the direction of extending the conveyor path of the conveyor belt 3. At the same time the dancer roller 10 moves upwardly as indicated by the arrow P2. The belt loop of the belt loop storage device 7 becomes smaller.

In FIG. 9 the cylinder 14 moves its stroke rod 15 with the roller head 31 upwardly as indicated by the arrow P5. In this case the cable 35 is put under a tensile loading and causes the carriage 6 to move rearwardly as indicated by the arrow P3, in the direction of reducing the length of the conveyor path of the conveyor belt 3. At the same time the dancer roller 10 moves downwardly as indicated by the arrow P4. The belt loop of the belt loop storage device 7 increases in size.

The pre-conveyor 1 is respectively brought into operation, for moving a workpiece 12 to the subsequent conveyor 2, under the control of the operator at the laying working station which for that purpose has available a hand or foot switch (not shown). If co-ordination of the movements as between the pre-conveyor 1 and the subsequent conveyor 2 is required, that co-ordination is effected by way of a control arrangement which is common to then.

Figure 10:
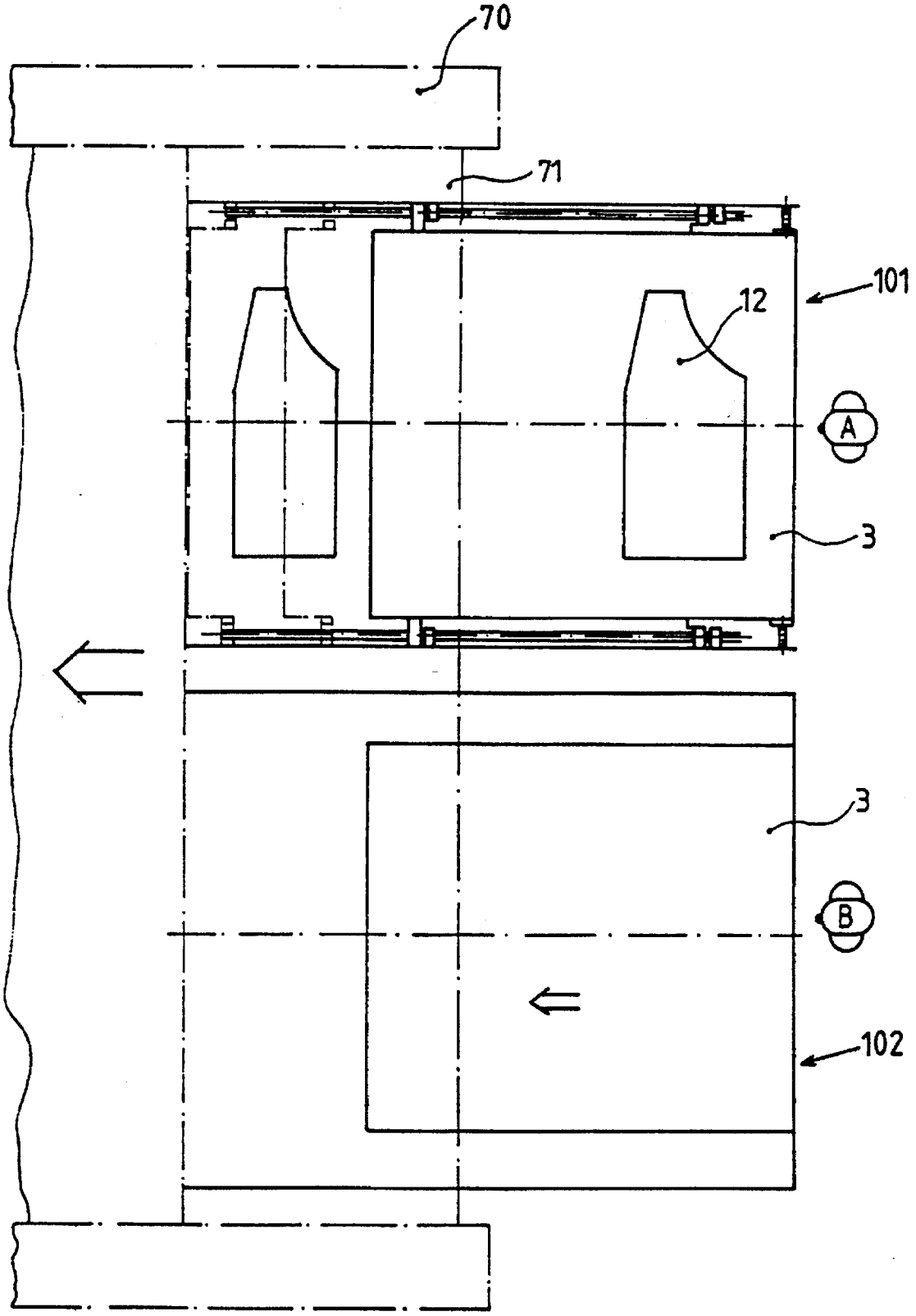
FIG. 10 shows an arrangement for feeding workpieces to a glueing apparatus having two laying working stations, omitting intermediate conveyors.

FIG. 10 shows a preferred embodiment for feeding workpieces to a glueing apparatus 70 by means of two pre-conveyors 101 and 102 which are arranged parallel to each other. Each of the two pre-conveyors 101 and 102 forms a laying working station for an operator A and B respectively. FIG. 10 only shows the entry side of the glueing apparatus 70 with the transport belt 71 which is moved continuously and uniformly in the direction indicated by the arrow. In that respect the width of the transport belt 71 is greater than the overall conveyor belt width of the two pre-conveyors 101 and 102. The feed of the workpieces 12 which are laid on the pre-conveyors 101 and 102 by the operators A and B, by way of the conveyor belts 3 thereof, to the transport belt 71 of the glueing apparatus 70, does not require intermediate conveyors. As already mentioned in connection with the description relating to FIGS. 1 to 4, that is possible by virtue of the fact that the workpieces 12 which are moved on the pre-conveyors 101 and 102 are deposited at a speed of return movement of the carriage 6, which is sufficiently high relative to the speed of conveying movement of the transport belt 71.

Figure 11:
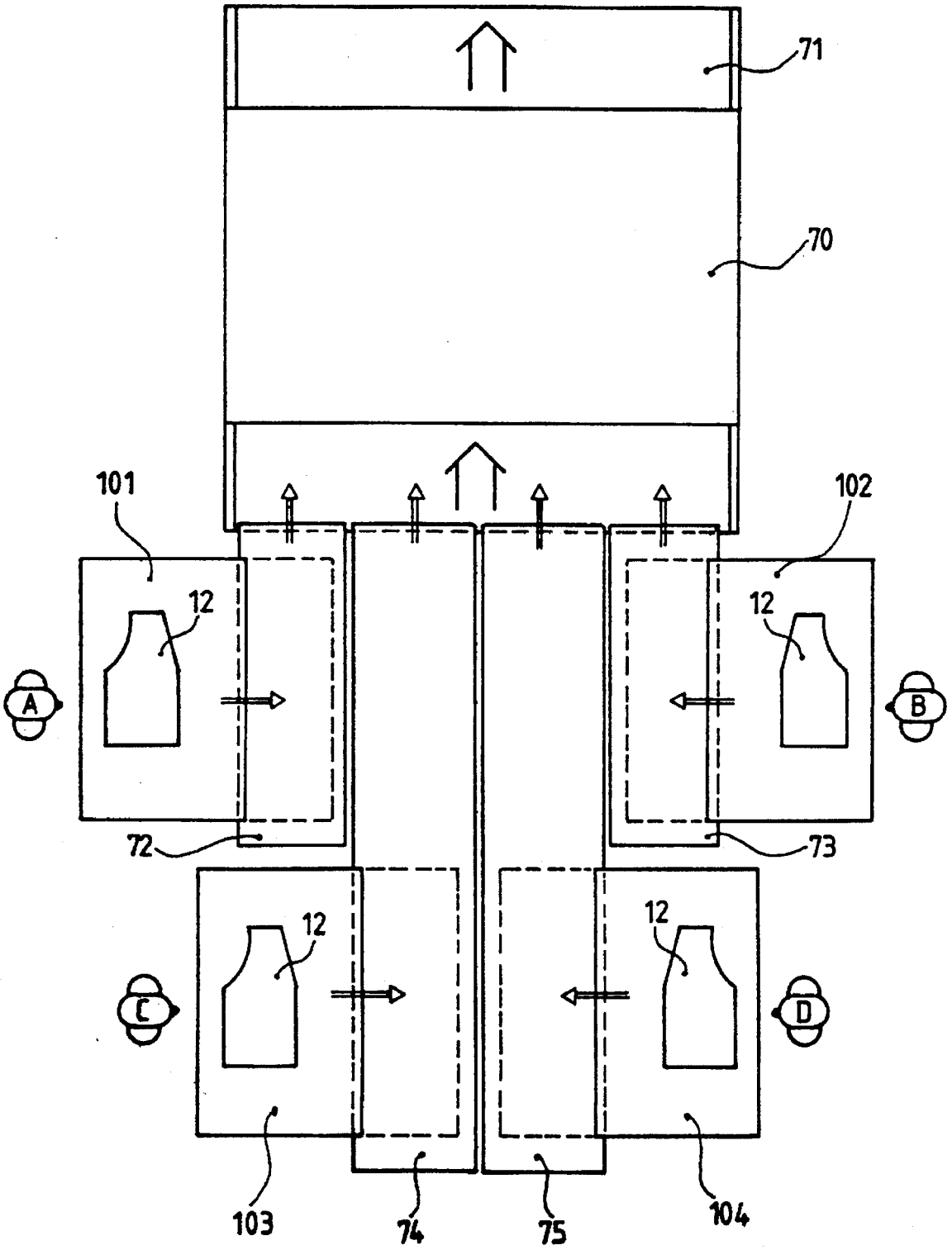
FIG. 11 shows an arrangement for feeding workpieces to a glueing apparatus with four laying working stations, using intermediate conveyors.

FIG. 11 shows an embodiment in respect of an arrangement for feeding workpieces to a glueing apparatus by means of four pre-conveyors 101, 102, 103 and 104 for four operators A, B, C and D who perform the laying operations. It will be clear from this embodiment how overall arrangements which are extremely compact from the point of view of space are possible precisely by virtue of the fact that pre-conveyor and subsequent conveyor can also be arranged perpendicularly to each other, in terms of their direction of conveying movement. As FIG. 11 shows, four intermediate conveyors 72, 73, 74 and 75 are arranged upstream of the transport belt 71 of the glueing apparatus 70, on the entry side thereof, in mutually parallel arrangement, in the direction of conveying movement as indicated by arrows. The overall conveyor width of the parallel arrangement of the intermediate conveyors 72, 73, 74 and 75 is again less than the width of the transport belt 71 of the glueing apparatus 70. By virtue of the differing lengths of the intermediate conveyors 72 and 73 in relation to the intermediate conveyors 74 and 75, it is possible to provide two pre-conveyors 101 and 103, and 102 and 104 respectively, in closely adjacent relationship, on each of the mutually oppositely disposed sides of the parallel arrangement of the intermediate conveyors. For the purposes of controlling the movements involved, a control arrangement (not shown in FIG. 9) is jointly associated with each intermediate conveyor 72, 73, 74 and 75 and the respective pre-conveyor 101, 102, 103 and 104 associated therewith. As soon as an operator A or B or C or D has laid a workpiece 12 on his pre-conveyor 101 or 102 or 103 or 104 respectively, he causes his pre-conveyor to start. The workpiece 12 is then moved by way of intermediate conveyors 72 or 73 or 74 or 75 respectively and deposited on the associated intermediate conveyor in the stationary condition thereof. The intermediate conveyor now conveys the transferred workpiece on to the transport belt 71 of the glueing apparatus 70 in order then to go back into the stationary condition again.

It will be appreciated that it is in principle also possible for the intermediate conveyors 72, 73, 74 and 75 to be operated continuously, that is to say independently of discontinuous operation of the pre-conveyors 101, 102, 103 and 104 respectively associated therewith. In that respect, when conveying workpieces 12 of small dimensions, for example shirt collar cut pieces which are to be provided with reinforcing interfacings, the speed of return movement of the carriage 6 of a pre-conveyor 101, 102, 103 and 104, in the transfer of a workpiece 12 to the associated intermediate conveyor 72, 73, 74 and 75, needs to be only immaterially higher than the speed of conveying movement thereof, in order to ensure trouble-free operation.

I claim:

1. A process for discontinuous pre-conveying of flat workpieces to a subsequent conveyor, wherein a workpiece is fed to a pre-conveyor at an entry end, passed through a conveyor section and discharged at an exit end to a subsequent conveyor, comprising the steps of providing a pre-conveyor and extending a conveyor belt path of the pre-conveyor in a direction of conveying movement and beyond a near edge of a conveyor path of a subsequent conveyor to dispose a workpiece laid on the pre-conveyor for movement in the conveying direction of the pre-conveyor and to a position above the conveyor path of the subsequent conveyor, providing the pre-conveyor conveyor belt with reverse motion-blocking means for permitting circulating movement of the pre-conveyor conveyor belt in only one direction, stopping the pre-conveyor when a workpiece moved on the pre-conveyor has reached a reference position relative to the conveyor path of the subsequent conveyor, transferring the moved workpiece to the subsequent conveyor for further movement by the subsequent conveyor by shortening the conveyor belt path of the pre-conveyor, and providing a further workpiece to the entry end of the pre-conveyor during said transfer of the moved workpiece on the subsequent conveyor.

2. A process according to claim 1 including the further step of stopping the subsequent conveyor at least during the transfer to it of a workpiece from the pre-conveyor.

3. A process according to claim 1 including operating the subsequent conveyor in a continuously switched-on mode and wherein the operation of shortening the conveyor belt path of the pre-conveyor is performed at a speed such that the transfer operation is not adversely affected by the conveyor path movement of the subsequent conveyor.

4. A process according to claim 1 including providing a glueing apparatus, and wherein the subsequent conveyor includes an intermediate conveyor which is arranged upstream of a glueing apparatus in the direction of the glueing apparatus conveying movement and wherein the intermediate conveyor is arranged for feeding to the glueing apparatus a workpiece which has been transferred from the pre-conveyor.

5. Apparatus for the discontinuous pre-conveying of flat workpieces to a workstation having a circulating transport belt with a first width transverse to the direction of belt advancement, said apparatus comprising a subsequent conveyor having two or more intermediate conveyors which operate independently of each other, which are disposed in mutually parallel arrangement, and which are arranged upstream of the workstation in the direction of conveying movement, a pre-conveyor associated with each of the intermediate conveyors, each pre-conveyor having reverse motion-blocking means for permitting circulating movement of the pre-conveyor in only one direction, the intermediate conveyors being arranged for feeding a workpiece transferred to them from the respectively associated pre-conveyor to the circulating transport belt of the workstation which is arranged downstream, and wherein the overall belt width of the parallel arrangement of the intermediate conveyors is smaller than or equal to the width of the transport belt of the workstation, and wherein said transport belt is arranged for receiving the workpieces delivered by the intermediate conveyors.

6. Apparatus according to claim 5 wherein the subsequent conveyor comprises a continuously circulating transport belt of a glueing apparatus, and wherein the pre-conveyor which transfers a workpiece moved thereon is arranged upstream of the transport belt of the glueing apparatus on the entry side thereof.

7. Apparatus according to claim 5 wherein said two or more pre-conveyors are disposed upstream of a glueing apparatus in the direction of conveying movement, and the overall belt width of the parallel arrangement of the pre-conveyors is smaller than or equal to the belt width of the transport belt of the glueing apparatus.

8. Apparatus according to claim 5 wherein the pre-conveyor has an endless conveyor belt which is guided over rollers, with a roller which provides for belt reversal through 180° at a rear end, and a carriage which is displaceable in the direction of conveying movement and which provides for belt reversal through 180° at a front end, and in a travel region the conveyor belt is passed over belt direction-changing rollers to constitute a belt loop storage device which is variable in size and which permits carriage movement.

9. Apparatus according to claim 8 wherein the carriage comprises a carriage plate with a carriage head which delimits the carriage plate at a front side, the carriage head has a ramp-like run-off profile configuration, and in this configuration an upper and a front lower belt edge of the carriage head are in the form of a tube or bar roller.

10. Apparatus according to claim 8 wherein the belt loop storage device between the belt direction-changing rollers which are arranged at a predetermined spacing has a dancer roller which forms the conveyor belt over the belt direction-changing rollers downwardly to form a belt loop which is substantially always tensioned.

11. Apparatus according to claim 8 wherein reverse motion-blocking means are provided at the roller which provides for belt reversal and the belt direction-changing rollers of the belt loop storage device.

12. Apparatus according to claim 8 wherein the carriage is guided with guide sleeves which are fixed to the carriage plate on both sides in guide rods which are mounted to the side walls of the support stand structure.

13. Apparatus according to claim 12 wherein the carriage drive is a cable drive having a stroke cylinder with a roller head having rollers and fixed to the free end of a stroke rod, the rollers of the roller head are in engagement with a first tension cable fixed to a rear end of the carriage plate for movement of the carriage in one direction and with a second tension cable which is fixed to a front end of the carriage plate for movement of the carriage in another direction, a roller guide means on a support stand structure, comprising a plurality of rollers, and the guidance of the tension cables in the roller guides is such that upon a stroke movement of the roller head in one direction the carriage performs a forward movement and in the opposite direction it performs a rearward movement.

14. Apparatus for the movement of workpieces along an endless conveyor belt path from an entry end to an exit end, said apparatus comprising an endless conveyor belt, means forming a conveyor belt path, belt loop storage means for keeping the conveyor belt always tensioned while allowing for motion when extending the conveyor belt path and, conversely, for shortening the conveyor belt path in a stationary condition, carriage means for altering the length of the conveyor belt path when moving a workpiece from the entry end to the exit end of the conveyor belt path, said carriage means being arranged for determining the front edge of the conveyor belt path and being moveable in the direction of the conveying movement, the conveyor belt path means being arranged such that the endless conveyor belt surrounds the belt loop storage means and the carriage means, and reverse motion-blocking means coupled to the endless conveyor belt for permitting circulating movement of the endless conveyor belt in only one direction, wherein a workpiece placed on the entry end of the conveyor belt path when the endless conveyor belt is in a stationary condition is moved to the exit end of the conveyor belt path by uni-directionally extending the conveyor belt path, the workpiece is transferred from the exit end of the conveyor belt path by shortening the conveyor belt path, and while the conveyor belt path is shortened a further workpiece may be placed on the endless conveyor belt which is again in a stationary condition at the conveyor belt path entry end.

* * * * *